US005756246A

United States Patent [19]

Woo et al.

[11] Patent Number: 5,756,246

[45] Date of Patent: May 26, 1998

[54] BI-LAYER BARRIER FOR PHOTORECEPTORS

[75] Inventors: Edward J. Woo, Woodbury, Minn.; David A. Ender, New Richmond, Wis.

[73] Assignee: Minnesota Mining and Manufacturing Company, St. Paul, Minn.

[21] Appl. No.: 897,024

[22] Filed: Jul. 18, 1997

Related U.S. Application Data

[63] Continuation of Ser. No. 630,101, Apr. 9, 1996, abandoned.

[51] Int. Cl.[6] ..... G03G 5/147

[52] U.S. Cl. ..... 430/66; 430/67; 430/58

[58] Field of Search ..... 430/58, 66, 67, 430/132

[56] References Cited

U.S. PATENT DOCUMENTS

| | | | |
|---|---|---|---|
| 4,348,469 | 9/1982 | Komiya et al. | 430/66 |
| 4,359,509 | 11/1982 | Guimond et al. . | |
| 4,409,309 | 10/1983 | Oka | 430/66 |
| 4,426,435 | 1/1984 | Oka | 430/132 |
| 4,439,509 | 3/1984 | Schank . | |
| 4,565,760 | 1/1986 | Schank . | |
| 4,595,602 | 6/1986 | Schank . | |
| 4,600,673 | 7/1986 | Hendrickson et al. . | |
| 4,606,934 | 8/1986 | Lee et al. . | |
| 4,923,775 | 5/1990 | Schank . | |
| 4,957,839 | 9/1990 | Rokutanzono et al. . | |
| 5,124,220 | 6/1992 | Brown et al. . | |

FOREIGN PATENT DOCUMENTS

| | | |
|---|---|---|
| WO 95/02853 | 4/1994 | WIPO . |

*Primary Examiner*—Christopher D. Rodee

*Attorney, Agent, or Firm*—Gary L. Griswold; Walter N. Kirn; Susan Moeller Zerull

[57] ABSTRACT

This invention is a photoreceptor element comprising, in order, an electroconductive support, a photoconductive layer, a barrier, and, preferably, a release layer. The barrier is a two layer system comprising:

1) adjacent to the photoconductive layer, a non-conductive, charge blocking layer, and 2) over the non-conductive, charge blocking layer, an electrically conductive barrier layer.

20 Claims, No Drawings

BI-LAYER BARRIER FOR PHOTORECEPTORS

This is a continuation of application Ser. No. 08/630,101 filed Apr. 9, 1996 now abandoned.

FIELD OF THE INVENTION

The present invention relates to a photoreceptor element. More specifically, this invention relates to a bi-layer barrier for the photoreceptor element.

BACKGROUND OF THE INVENTION

Electrophotography forms the technical basis for various well known imaging processes, including photocopying and some forms of laser printing. The basic electrophotographic process involves placing a uniform electrostatic charge on a photoreceptor element, imagewise exposing the photoreceptor element to activating electromagnetic radiation, also referred to herein as "light", thereby dissipating the charge in the exposed areas, developing the resulting electrostatic latent image with a toner, and transferring the toner image from the photoreceptor element to a final substrate, such as paper, either by direct transfer or via an intermediate transfer material.

The toner may be either a powdered material comprising a blend of polymer and colored particulates, typically carbon, or a liquid material of finely divided solids dispersed in an insulating liquid. Liquid toners are often preferable because they are capable of giving higher resolution images. In liquid electrophotography (referred to herein as LEP), the photoreceptor element is charged to a particular voltage, termed the charge acceptance voltage. Image-wise exposure to radiation reduces the surface voltage in the imaged area to a residual potential, $V_R$, which is less than the charge acceptance value of the surface of the photoreceptor element. Typically a development roll biased with a voltage greater than the residual potential and less than the charge acceptance voltage provides an electric field which drives positively charged toner particles toward the discharged areas of the photoreceptor surface.

The toner image may be transferred to the substrate or an intermediate carrier by means of heat, pressure, a combination of heat and pressure, or electrostatic assist. A common problem that arises at this stage of electrophotographic imaging is poor transfer from the photoconductor to the receptor. Poor transfer may be manifested by low transfer efficiency and low image resolution. Low transfer efficiency results in images that are light and/or speckled. Low image resolution results in images that are fuzzy. These transfer problems may be alleviated by the use of a release coating.

The structure of a photoreceptor element may be a continuous belt, which is supported and circulated by rollers, or a rotatable drum. All photoreceptor elements have a photoconductive layer which conducts electric current when it is exposed to activating electromagnetic radiation and is an insulator under other conditions. The photoconductive layer is generally affixed to an electroconductive support. The surface of the photoconductor is either negatively or positively charged such that when activating electromagnetic radiation strikes the photoconductive layer, charge is conducted through the photoconductor in that region to neutralize or reduce the surface potential in the illuminated region. An optional barrier layer may be used over the photoconductive layer to protect the photoconductive layer and extend the service life of the photoconductive layer. Other layers, such as adhesive or priming layers or substrate injection charge blocking layers, are also used in some photoreceptor elements.

Known photoconductive layers include but are not limited to (a) an inorganic photoconductor material in particulate form dispersed in a binder or, more preferably, (b) an organic photoconductor material. Photoconductor elements having organic photoconductor material are discussed in Borsenberger and Weiss, *Photoreceptors: Organic Photoconductors*, Ch. 9 Handbook of Imaging Materials, Ed. Arthur S. Diamond, Marcel Dekker, Inc. 1991. When an organic photoconductor material is used, the photoconductive layer can be a bilayer construction consisting of a charge generating layer and a charge transport layer. The charge generating layer is typically about 0.01 to 5 μm thick and includes a material which is capable of absorbing light to generate charge carriers, such as a dyestuff or pigment. The charge transport layer is typically 10–20 μm thick and includes a material capable of transferring the generated charge carriers, such as poly-N-vinylcarbazoles or derivatives of bis-(benzocarbazole)-phenylmethane in a suitable binder.

In standard use of bilayer (also referred to as dual layer) organic photoconductor materials in photoconductor elements, the charge generation layer is located between the conductive substrate and the charge transport layer. Such a photoconductor element is usually formed by coating the conductive substrate with a thin coating of a charge generation layer, overcoated by a relatively thick coating of a charge transport layer. During operation, the surface of the photoconductor element is negatively charged. Upon imaging, in the light-struck areas, hole/electron pairs are formed at or near the charge generation layer/charge transport layer interface. Electrons migrate through the charge generation layer to the conductive substrate while holes migrate through the charge transport layer to neutralize the negative charge on the surface. In this way, charge is neutralized in the light-struck areas.

Alternatively, an inverted bilayer system may be used. Photoconductor elements having an inverted bilayer organic photoconductor material require positive charging which results in less deterioration of the photoreceptor surface. In a typical inverted bilayer system, the conductive substrate is coated with a relatively thick coating (about 5 to 20 μm) of a charge transport layer, overcoated with a relatively thin (0.05 to 1.0 μm) coating of a charge generation layer. During operation, the surface of the photoreceptor is positively charged. Upon imaging, in the light-struck areas, hole/electron pairs are formed at or near the charge generation layer/charge transport layer interface. Electrons migrate through the charge generation layer to neutralize the positive charge on the surface while holes migrate through the charge transport layer to the conductive substrate. In this way, charge is again neutralized in the light-struck areas.

As yet another alternative, an organic photoconductive layer can comprise a single-layer construction containing a mixture of charge generation and charge transport materials and having both charge generating and charge transport capabilities. Examples of single-layer organic photoconductive layers are described in U.S. Pat. Nos. 5,087,540 and 3,816,118.

A barrier layer, which is typically positioned between the photoconductive layer and the release layer, may be used to enhance durability and extend the service life of the photoconductive layer. To be effective in this capacity, the barrier layer should ideally meet many different performance criteria. First, the barrier layer should protect the photoconductive layer from corona-induced charge injection. Corona-induced charge injection can limit or reduce the charge acceptance voltage and can fill the organic photoconductor element with unwanted trapped charge. In addition, corona-induced charge injection can cause damage which reduces the useful life of the photoconductive layer. Damage occurs when ionized particles are permitted to directly contact the photoconductive layer. The corona also creates ozone and certain detrimental ionized particles which can damage the photoconductive layer if permitted to directly contact that layer. Ozone and detrimental ionized particles from the corona are believed to damage the photoconductive layer by directly or indirectly causing unwanted reactions with the photoconductive layer, e.g., oxidation. An effective barrier layer prevents or minimizes direct contact of the photoconductive layer by ozone and ionized particles which are produced by the corona.

A second requirement of the barrier layer is that it should be substantially inert with respect to the photoconductive layer. That is, the barrier layer should not chemically react with the photoconductive layer to the extent that the performance of the photoconductive layer is detrimentally affected and "trap sites" form between the barrier layer and the photoconductive layer. Trap sites are localized voids which can retain charge, thereby inhibiting rapid discharge of the photoconductor element. Therefore, the existence of trap sites require long "warm-up" periods before the photoreceptor system reaches stable operating conditions.

The barrier layer should adhere well to the photoconductive layer and the release layer without the need for adhesives. The barrier layer, desirably, is also resilient to compressional and tensional forces that may be exerted on the photoreceptor element. In addition, a barrier layer in a system used with liquid toners must prevent or substantially limit the liquid toner from contacting the photoconductive layer. Liquid toners typically comprise toner particles dispersed in a carrier liquid.

Finally, the barrier layer should not substantially contribute to the residual potential. Such undesirable increase in residual potential may result from trap sites or from the capacitive or resistive nature of the layer.

A variety of single layer barrier layers have been disclosed in the art. See e.g., U.S. Pat. Nos. 4,359,509; 4,565,760; 4,595,602; 4,606,934; 4,923,775; and 5,124,220; and WO95/02853.

However, single layer barrier systems suffer from a limitation. Although the barrier to liquid toners is improved if the barrier layer is thick, image quality typically deteriorates as the barrier layer becomes thicker.

SUMMARY OF THE INVENTION

The inventors have learned that image quality deteriorates, at least in part, because $V_R$ increases with barrier layer thickness. The increase in $V_R$ can be counteracted by use of an electrically conductive barrier layer. Unfortunately, electrically conductive barrier layers do not protect adequately against charge injection with resulting low charge acceptance voltage, high levels of trapped charge and discharge ghosts. Discharge ghosts are residual potential differences that occur between previously discharged and undischarged regions of the photoreceptor element.

The inventors have also discovered that inverted bilayer photoconductive systems are especially vulnerable to liquid toners. Therefore, the inventors discovered that a two layer barrier system for photoreceptor elements which provides excellent barrier properties against liquid toners without a deterioration in image quality. The photoreceptor elements of this invention comprise, in order, an electroconductive support, a photoconductive layer, a barrier, and, preferably, a release layer. The barrier is a two layer system comprising:

1) adjacent to the photoconductive layer, a non-conductive, charge blocking layer, and
2) over the non-conductive, charge blocking layer, an electrically conductive barrier layer.

DETAILED DESCRIPTION OF THE INVENTION

The photoconductor construction of this invention comprises an electroconductive substrate which supports at least a photoconductor layer and a barrier layer. The photoconductors of this invention may be of a drum type construction, a belt construction, or any other construction known in the art.

Electroconductive substrates for photoconductive systems are well known in the art and are generally of two general classes: (a) self-supporting layers or blocks of conducting metals, or other highly conducting materials; (b) insulating materials such as polymer sheets, glass, or paper, to which a thin conductive coating, e.g. vapor coated aluminum, has been applied.

The photoconductive layer can be any type known in the art, including (a) an inorganic photoconductor material in particulate form dispersed in a binder or, more preferably, (b) an organic photoconductor material. The thickness of the photoconductor is dependent on the material used, but is typically in the range of 5 to 150 μm.

Photoconductor elements having organic photoconductor material are discussed in Borsenberger and Weiss, *Photoreceptors: Organic Photoconductors*, Ch. 9 Handbook of Imaging Materials, Ed. Arthur S. Diamond, Marcel Dekker, Inc. 1991. When an organic photoconductor material is used, the photoconductive layer can be a bilayer construction consisting of a charge generating layer and a charge transport layer. The charge generating layer is typically about 0.01 to 5 μm thick and includes a material which is capable of absorbing light to generate charge carriers, such as a dyestuff or pigment. The charge transport layer is typically 10–20 μm thick and includes a material capable of transferring the generated charge carriers, such as poly-N-vinylcarbazoles or derivatives of bis-(benzocarbazole)-phenylmethane in a suitable binder.

In standard use of bilayer organic photoconductor materials in photoconductor elements, the charge generation layer is located between the conductive substrate and the charge transport layer. Such a photoconductor element is usually formed by coating the conductive substrate with a thin coating of a charge generation layer, overcoated by a relatively thick coating of a charge transport layer. During operation, the surface of the photoconductor element is negatively charged. Upon imaging, in the light-struck areas, hole/electron pairs are formed at or near the charge generation layer/charge transport layer interface. Electrons migrate through the charge generation layer to the conductive substrate while holes migrate through the charge transport layer to neutralize the negative charge on the surface. In this way, charge is neutralized in the light-struck areas.

Alternatively, an inverted bilayer system may be used. Photoconductor elements having an inverted bilayer organic photoconductor material require positive charging which results in less deterioration of the photoreceptor surface. In a typical inverted bilayer system, the conductive substrate is coated with a relatively thick coating (about 5 to 20 μm) of a charge transport layer, overcoated with a relatively thin (0.05 to 1.0 μm) coating of a charge generation layer. During operation, the surface of the photoreceptor is positively charged. Upon imaging, in the light-struck areas, hole/electron pairs are formed at or near the charge generation layer/charge transport layer interface. Electrons migrate through the charge generation layer to neutralize the positive charge on the surface while holes migrate through the charge transport layer to the conductive substrate. In this way, charge is again neutralized in the light-struck areas.

As yet another alternative, an organic photoconductive layer can comprise a single-layer construction containing a mixture of charge generation and charge transport materials and having both charge generating and charge transport capabilities. Examples of single-layer organic photoconductive layers are described in U.S. Pat. Nos. 5,087,540 and 3,816,118.

Suitable charge generating materials for use in a single layer photoreceptor and/or the charge generating layer of a dual layer photoreceptor include azo pigments, perylene pigments, phthalocyanine pigments, squaraine pigments, and two phase aggregate materials. The two phase aggregate materials contain a light sensitive filamentary crystalline phase dispersed in an amorphous matrix.

The charge transport material transports the charge (holes or electrons) from the site of generation through the bulk of the film. Charge transport materials are typically either molecularly doped polymers or active transport polymers. Suitable charge transport materials include enamines, hydrazones, oxadiazoles, oxazoles, pyrazolines, triaryl amines, and triaryl methanes. A suitable active transport polymers is polyvinyl carbazole. Especially preferred transport materials are polymers such as poly(N-vinyl carbazole) and acceptor doped poly(N-vinylcarbazole). Additional materials are disclosed in Borsenberger and Weiss, *Photoreceptors: Organic Photoconductors*, Ch. 9 Handbook of imaging Materials, Ed. Arthur S. Diamond, Marcel Dekker, Inc. 1991.

Suitable binder resins for the organic photoconductor materials include, but are not limited to, polyesters, polyvinyl acetate, polyvinyl chloride, polyvinylidene dichloride, polycarbonates, polyvinyl butyral, polyvinyl acetoacetal, polyvinyl formal, polyacrylonitrile, polyacrylates such as polymethyl methacrylate, polyvinyl carbazoles, copolymers of monomers used in the above-mentioned polymers, vinyl chloride/vinyl acetate/vinyl alcohol terpolymers, vinyl chloride/vinyl acetate/maleic acid terpolymers, ethylene/vinyl acetate copolymers, vinyl chloride/vinylidene chloride copolymers, cellulose polymers and mixtures thereof. Suitable solvents used in coating the organic photoconductor materials include, for example, nitrobenzene, chlorobenzene, dichlorobenzene, trichloroethylene, tetrahydrofuran, and the like.

Inorganic photoconductors such as, for example, zinc oxide, titanium dioxide, cadmium sulfide, and antimony sulfide, dispersed in an insulating binder are well known in the art and may be used in any of their conventional versions with the addition of sensitizing dyes where required. The preferred binders are resinous materials, including, but not limited to, styrenebutadiene copolymers, modified acrylic polymers, vinyl acetate polymers, styrene-alkyd resins, soya-alkyl resins, polyvinylchloride, polyvinylidene chloride, acrylonitrile, polycarbonate, polyacrylic and methacrylic esters, polystyrene, polyesters, and combinations thereof The barrier system of this invention comprises a first non-conductive, charge blocking layer. This layer preferably comprises silica in a polymeric binder. The binder is preferably a crystalline or semi-crystalline polymer that is resistant to the solvent used to coat the second, electrically conductive barrier layer. The binder should have a low permeability to assure maximum protection of the photoconductor layer. Preferred polymers have oxygen permeability coefficients at 25° C. of less than $1\times10^{-14}$, more preferably less than $1\times10^{-15}$ $cm^2/s.Pa$. The binder should be aqueous coatable because if it is necessary to coat the layer from a solvent there is a risk of interactions between the solvent and the photoconductive layer. However, if the photoconductive layer is resistant to solvents a solvent coatable binder may be acceptable. Some preferred binders include sulfonated polyesters, polyvinyl alcohols, acrylonitrile/styrene copolymers, acrylonitrile/methacrylate/butadiene copolymers, polyvinylidene chloride, vinyl ether/maleic anhydride copolymers, polyacrylonitrile, vinyl chloride/polyvinylidene dichloride copolymers, and mixtures of polyvinyl alcohol with methylvinylether/maleic anhydride copolymer. The latter mixtures are especially preferred as providing very good charge injection protection. Preferably, the binder is cross-linkable. The crosslinker must not effect electrostatic discharge performance of the charge blocking layer. Suitable crosslinkers include aziridine based crosslinkers, maleic anhydride, carboxylic acid functional crosslinkers.

The silica particles preferably are colloidal silica having average diameter from 5 to 200 nm. The amount of silica may be from about 10 to 90% by weight of the non-conductive, charge blocking layer and more preferably is in the range of 20 to 40% by weight of the non-conductive, charge blocking layer. The non-conductive, solvent resistant layer preferably has a thickness in the range of 0.03 to 0.1 μm.

The electrically conductive barrier layer is located over the non-conductive charge blocking layer. The electrically conductive barrier layer preferably comprises a conductive additive in a polymeric binder. Suitable conductive additives include conductive pigments, conductive polymers, doped conductive polymer compositions such as polypyrrole, and photoconductive organic molecules, usually conjugated aromatic compounds such as dibromoanthrone. Conductive pigments (or conductive particles) are preferred. The amount of conductive pigment is preferably less than 20%, more preferably 5–15%, by weight of the conductive barrier layer. If the amount of conductive particle is too high a significant amount of cracking will be observed in the coating. No significant benefit in image quality is observed by increasing the particle levels over 20%. The conductive particle may be any known particle having electrical conducting properties. Preferred particles include photoconductive $TiO_2$, vanadium oxides, etc. Especially preferred particles are $Sb_2O_3/SnO_2$ composite particles.

The polymeric binder for the electrically conductive barrier layer may be a variety of polymers provided that the binder is millable, can be coated out of a solvent, and the conductive additive is dispersible in the binder. Preferably, the binder system is cross-linkable. Preferred polymers include polyesters having crosslinkable pendant or end groups, polyacetal, polyvinyl butyral, polysulfones, polyurethanes, polyacrylates. Preferably, the electrically conductive barrier layer is solvent coated over the non-conductive charge blocking layer. Preferred solvents include hydrocarbons, alcohols and methyl ethyl ketone. The solvent limitations on the binder will depend on the characteristics of adjacent layers. Adjacent layers should not be disturbed nor disturb this layer when the layers are coated. The dried thickness of the electrically conductive barrier layer is preferably greater than 0.3 μm, more preferably 0.5 to 1.5 μm.

Optionally, silica may also be added to the electrically conductive barrier layer. The amount of silica may be up to about 90% by weight of the electrically conductive barrier layer, but more preferably is in the range of 10 to 40% by weight of the electrically conductive barrier layer. Most preferably, the total amount of particles (conductive and non-conductive) in this layer is less than 50%, more preferably less than 40%, by weight of the layer.

A release layer applied over the barrier system is desirable. The release layer may be any release layer known in the art. Silicone polymer release layers are well known and are preferred. Examples of suitable release layer materials include Syl-off™23 and Syl-Off™12 (Dow Corning Corp.) and the bimodal vinyl silicone polymer disclosed in pending U.S. patent application Ser. No. 08/429928.

EXAMPLES

Preparation of Photoconductive layer

An inverted dual layer photoconductor was coated onto an aluminized polyester film as follows:

To 1000 gm of 12.5% polycarbonate Z (Mitsubishi Gas Co.)/PE 2200 (Shell Chemical Co.) (99:1) in toluene was added 62.5 gm 9-ethylcarbazole-3-aldehyde-N-methyl-N-phenyl-hydrazone and 62.5 gm 9-ethylcarbazole-3-aldehyde-N,N-diphenyl-hydrazone. This mixture was dissolved and coated onto aluminized polyester film and dried to afford a 15 micron charge transport layer. On top the charge transport layer was coated a 2.8% solids dispersion of (1:1) x-form-metal-free phthalocyanine (Zeneca, Ltd.)/S-lec Bx-5 (Sekisui Chemical Co.) to afford a 0.1 micron dried charge generation layer.

Preparation of electroconductive layer stock solution I

Six grams of Sekisui BX-5 polyvinylbutyral were dissolved in 96 g of methanol. To this solution, 0.9 g of $SnO_2$/SbO electroconductive powder from Konishi International Inc. and 0.4 g 3-glycidylpropyltrimethoxysilance (Z6040 from Dow Corning Corp.) were added. The mixture was milled with a ceramic ball for 48 hours.

Solutions for coating of the electroconductive barrier layer were prepared having the following formulations.

TABLE 1

CONDUCTIVE BARRIER FORMULATIONS

| Sample # | Stock sol. (g) | 6% BX-5 in $CH_3OH$ (g) | Nalco 1057 (g) | 1.5% AN169 in $H_2O$/$CH_3OH$ (g) | IPA (g) | conductive particles as % of solids | Calc. thickness (μm) |
|---|---|---|---|---|---|---|---|
| CB-1 | 1.64 | 8.125 | 0.756 | 3.93 | 19.7 | 3.65 | 0.65 |
| CB-2 | 1.64 | 8.129 | 0.46 | 3.93 | 20.0 | 2.1 | 0.65 |
| CB-3 | 1.64 | 8.125 | 0.756 | 3.93 | 10.45 | 3.65 | 1.30 |
| CB-4 | 3.28 | 5.41 | 0.756 | 3.93 | 10.45 | 10.5 | 0.69 |
| CB-5* | 1.64 | 8.125 | 0.756 | 3.93 | 19.7 | 3.65 | 0.65 |
| CB-6** | — | 6.57 | 1.01 | 3.93 | 13.74 | — | 0.20 |

Stock solution I was used unless othewise noted.

BX-5 polyvinylbutyral from Sekisui.

Nalco 1057 colloidal silica from Nalco.

AN 169 is methylvinylether/maleic anhydride copolymer.

IPA is isopropyl alcohol

*Prepared from the stock solution II. (ICI Dibromoanthrone BX948/1 was used as the conductive additives.)

**Sample CB-6 was not a conductive barrier. Also included 1.0 g 5% glycidyl propyltrimethoxy silane.

Charge blocking layer formulation

Solutions for coating the non-conductive charge blocking layer were prepared having the following formulations:

TABLE 2

FORMULATION OF DIFFERENT CHARGE BLOCKING LAYERS

| Sample # | 4% PVA in $H_2O$ | 6% BX-5 in methanol | 30% polyacrylate latex in $H_2O$ | 1.5% AN169 in $H_2$/$CH_3OH$ | NALCO 2326 in $H_2O$ | NALCO 1057 in $H_2O$ | 10% TX100 in $H_2O$ | IPA | H2O |
|---|---|---|---|---|---|---|---|---|---|
| B-1 | 5.54 | — | — | 1.23 | 0.4 | — | 0.1 | — | 32.73 |
| B-2 | 5.54 | — | — | 1.23 | 0.4 | — | 0.1 | — | 65.46 |
| B-3 | — | 6.57 | — | 3.93 | — | 1.98 | — | 145 | — |
| B-4 | — | — | 1.0 | — | — | — | 0.1 | — | 29.0 |
| B-5 | 2.77 | — | 0.5 | 0.61 | — | 0.2 | 0.1 | — | 35.8 |
| B-6 | 4.12 | — | 0.25 | 0.92 | — | 0.3 | 0.1 | — | 34.1 |

All values are in grams.
PVA is polyvinyl alcohol.
BX-5 polyvinylbutyral from Sekisui.
Nalco 1057 colloidal silica from Nalco.
Nalco 2326 colloidal silica from Nalco.
AN 169 is methylvinylether/maleic anhydride copolymer.
IPA is isopropyl alcohol.
TX100 is Triton X-100 surfactant.

Preparation of electroconductive layer stock solution II

The procedure for preparing stock solution I was repeated with the exception that 0.9 g of dibromoanthrone photoconductive additive was used instead of $SnO_2$/SbO electroconductive powder as the conductive additive.

Preparation of Electroconductive layer solutions

Calculated thicknesses for these solutions were

B-1: 0.070 μm,

B-2: 0.035 μm,

B-3: 0.070 μm,

B-4: 0.070 μm,

B-5: 0.070 μm, and

B-6: 0.070 μm.

Release layer formulation

A release layer coating solution was prepared with the following formulation:

5.0 g of 15% Syl-off 23 (silicone polymer from Dow Corning Corp.)

0.56 g NM203 (polymethylhydrosiloxane from Huls America)

0.187 g PS342.5 (siloxane from Huls America)

33.72 g heptane 0.12 g Pt catalyst

Coating procedure

The charge blocking layer, conductive barrier layer, and the release layer were coated onto the photoconductive layer using a ring coating process. First, the charge blocking layer solution was ring coated onto the photoconductive layer at a speed of 0.41 cm/sec. This layer was cured at 150° C. for 5 minutes. The conductive barrier coating solution was ring coated over the charge blocking layer at 0.41 cm/sec. This layer was also cured at 150° C. for 5 minutes. Finally, the release coating solution was ring coated over the conductive barrier layer at 2.3 cm/sec. This layer was cured at 150° C. for 10 minutes.

Initial Electrostatic Property Test

The initial electrostatic property test was performed by charging the surface of the photoreceptor element from a scorotron to a surface potential of about 600 to 650 volts (charge acceptance). The surface potential was discharged to a residual potential, $V_R$, by exposure to a 780 nm diode laser. The entire surface of the photoreceptor was then erased by a 715 nm LED array. These steps constitute one cycle and were repeated eleven times to measure charge acceptance and $V_R$.

4000 Cycle Charging and Discharging Test

The charge, discharge, and erase steps were performed for 4000 continuous cycles. Data was collected every 200 cycles to determine electrostatic stability of charge acceptance and discharge over a large number of cycles.

Wet Image Cycling Test

In addition to the charge and discharge steps, a development step was added before the erase step. Liquid toner was brought into the development region between the photoreceptor element and a development roll biased with a voltage of about 500V (this is greater than the typical $V_R$ of about 200V). The gap between the photoreceptor element and the bias roll was about 6 mils. After the development step, a drying roll at 60° C. was used to remove any of the residual carrier liquid of the liquid toner. Electrostatic data was collected initially and at select cycle intervals. No development step occurred during cycles in which data was collected. This test provides information on electrostatic stability under the influence of multiple wet development cycles.

Example 1

Formulation CB-1 was coated directly onto the photoconductive layer and cured as described above. The release layer was coated over the conductive barrier layer and cured as described above. This sample was evaluated by the 11 cycle initial electrostatic test. The results indicate that this sample did not have a stable charge acceptance property. This problem perhaps caused by charge injection into the organic photoconductor from the conductive additives in the barrier coating.

Examples 2–12

The charge blocking layer formulations from Table 2 were coated onto the photoconductive layer and cured as described above. Various conductive solutions and the release layer solution were each subsequently coated and cured as described above. These samples were tested under the initial Electrostatic Test for Charge Acceptance Property. The results are found in Table 3 below. Charge blocking layer comprising IPA and acrylate binders provided unacceptable charge acceptance.

TABLE 3

INITIAL ELECTROSTATIC PROPERTY TEST

| Example # | Charge blocking layer | Conductive Barrier Layer | Charge Acceptance Property |
|---|---|---|---|
| 1-Control | None | CB-1 | poor |
| 2 | B-1 | CB-1 | good |
| 3 | B-2 | CB-1 | good |
| 4 | B-1 | CB-2 | good |
| 5 | B-1 | CB-3 | good |
| 6 | B-1 | CB-4 | good |
| 7 | B-1 | CB-5 | good |
| 8 | B-3 | CB-1 | poor |
| 9 | B-3 | CB-2 | poor |
| 10 | B-4 | CB-1 | poor |
| 11 | B-5 | CB-1 | poor |
| 12 | B-6 | CB-1 | poor |

Example 13–20

Other binders for the charge blocking layer were investigated:

a. a mixture of Polyvinyl alcohol (PVA) and methylvinylether/maleic anhydride copolymer Gantrez (AN169). –4% in methanol.

b. Silane terminated Polyurethane dispersion.

c. Polyacrylate latex 30% in water.

d. BF Goodrich Hycar 26138 polyacrylic-acrylnitrile latex. (50% by weight solids).

e. BF Goodrich Hycar 26373 Polyacrylic-acrylnitrile latex (58% by weight solids).

f. BF Goodrich Sancure 776 Polyurethane dispersion (38% by weight solids).

These binders were combined with other components as shown in Table 4 below form aqueous coating solutions. The coating solution were coated directly onto the photoconductive layer and tested under the Initial Electrostatic Test. The binder systems containing polyurethanes and polyacrylates did not show good charge-acceptance performance, indicating poor charge injection blocking properties.

TABLE 4

| Example | Binder | AN169 1.5% | deionized water | Nalco 2326 15% solids | TX-100 10% solids | Electro-static Result |
|---|---|---|---|---|---|---|
| 13 | a. 5.54 g | 1.23 g | 32.73 g | 0.4 g | 0.1 g | good |
| 14 | b. 0.63 g | — | 31.60 g | 0.4 g | 0.1 g | poor |
| 15 | c. 0.1 g | — | 29.0 g | — | 0.1 g | poor |

TABLE 4-continued

| Example | Binder | AN169 1.5% | deionized water | Nalco 2326 15% solids | TX-100 10% solids | Electro-static Result |
|---|---|---|---|---|---|---|
| 16 | a. 2.77 g<br>c. 0.5 g | 0.61 g | 35.8 g | 0.2 g* | 0.1 g | poor |
| 17 | a. 4.12 g<br>c. 0.25 g | 0.92 g | 34.1 g | 0.3 g* | 0.1 g | poor |
| 18 | d. 0.48 g | — | 32.73 g | 0.4 g | 0.1 g | poor |
| 19 | e. 0.41 g | — | 32.73 g | 0.4 g | 0.1 g | poor |
| 20** | f. 0.65 g | — | 32.73 g | 0.4 g | 0.1 g | poor |

*Nalco 1057 colloidal silica used which has 30% solids
**Made with 0.1 g Xama-7 is the polyaziridine cross-linker from B. F. Goodrich, OH.

Example 21

For the PVA/AN169 binder aziridine based crosslinkers and hydrolyzed silane crosslinkers were tried. These charge blocking layers were coated on a photoconductive layer. Incorporation of hydrolyzed silane cross-linkers caused a deterioration in electrostatic discharge performance suggesting that these cross-linkers cause poor charge blocking properties. Aziridine cross-linkers had no effect of electrostatic discharge performance.

Examples 22–29

Various charge blocking layer coating solutions and various conductive layer coating solutions were coated onto the photoconductive layer and cured as described above. The release layer solution was subsequently coated and cured as described above. These photoreceptor constructions were tested for 4000 cycle non-functional charging and discharging Test. The results are shown in the Table below. The photoreceptor elements which have only a charge blocking layer or only a conductive barrier layer displayed higher ramp-up and displayed significant discharge ghost. When dibromoanthrone was used as the conductive additive a small increase in $V_R$ and some discharge ghost was detected.

TABLE 5

4000 CYCLE CHARGING AND DISCHARGING TEST

| Example | Charge blocking layer | Conductive Barrier Layer | Charge Up Stability | Change in $V_R$ after 4000 Cycles | Discharge Ghost |
|---|---|---|---|---|---|
| 22 | CB-6* | — | good | 100 V | 50 V |
| 23 | CB-6** | — | good | 40 V | 50 V |
| 24 | B-1 | CB-1 | good | ~0 | no |
| 25 | B-2 | CB-1 | good | ~0 | no |
| 26 | B-1 | CB-2 | good | ~0 | no |
| 27 | B-1 | CB-3 | good | ~0*** | no |
| 28 | B-1 | CB-4 | good | ~0 | no |
| 29 | B-1 | CB-5 | good | 20 V | 20 V |

*Thickness of 0.35 μm
**Thickness of 0.15 μm
***Example 27 showed a lower residual voltage after 4K cycles, and the discharge voltage remained constant.

Examples 30–34

Photoreceptor samples were prepared using various blocking and conductive barrier coating solutions. A release coat was applied over the conductive barrier layer. Coating procedures were as described above. These samples were subjected to the Wet Image Cycling Test. Results are shown in Table 6. The values for the change in $V_R$ and discharge ghost are given at after the number of cycles set forth in the Table. The bilayer system showed superior durability, change in $V_R$ and discharge ghost over the single layer systems.

TABLE 6

WET IMAGE CYCLING TEST

| Example | System | Blocking | Barrier | Final Cycle # | Change in $V_R$ (Volts) | Discharge Ghost (Volts) |
|---|---|---|---|---|---|---|
| 30 | No Barrier | — | — | 188 | ~200 | ~75 |
| 31 | Blocking | * | — | 405 | ~100 | ~75 |
| 32 | Blocking | CB-6** | — | 406 | ~50 | ~40 |
| 33 | Blocking | CB-6*** | — | 408 | ~60 | ~20 |
| 34 | Bilayer | B-1 | CB-1 | 994 | ~0 | ~0 |

*This non-conductive barrier was described in WO95/02853.
**Thickness 0.15 μm.
***Thickness 0.20 μm.

What is claimed is:

1. A photoreceptor element comprising an electroconductive substrate; a photoconductive layer on the electroconductive substrate; and over the photoconductive layer, a barrier system comprising a non-conductive charge blocking layer adjacent to the photoconductive layer, and an electroconductive barrier layer over the non-conductive charge blocking layer, wherein the non-conductive charge blocking layer has a thickness in the range of 0.03 to 0.1 μm and comprises silica and a semi-crystalline polymeric binder.

2. The element of claim 1 further comprising a release layer over the barrier system.

3. The element of claim 1 wherein the polymeric binder has an oxygen permeability coefficient of less than $1\times10^{-14}$ $cm^2/s.Pa$.

4. The element of claim 1 wherein the polymeric binder has an oxygen permeability coefficient of less than $1\times10^{-15}$ $cm^2/s.Pa$.

5. The element of claim 1 wherein the amount of silica is from 10 to 90% by weight of the non-conductive charge blocking layer.

6. The element of claim 1 wherein the polymeric binder is aqueous dispersible.

7. The element of claim 1 wherein the polymeric binder is crosslinkable.

8. The element of claim 1 in which the silica particles have an average diameter from 5 to 200 nm.

9. The element of claim 1 in which the amount of silica is in the range of 20 to 40% by weight of the non-conductive, charge blocking layer.

10. The element of claim 1 wherein the electroconductive barrier layer comprises a conductive additive and a polymeric binder.

11. The element of claim 10 wherein the electroconductive barrier layer further comprises silica.

12. The element of claim 11 wherein the amount of silica is in the range of 10 to 40% by weight of the electroconductive layer.

13. The element of claim 11 wherein the total amount of conductive and non-conductive particles is less than 50% by weight of the electroconductive layer.

14. The element of claim 10 wherein the conductive additive is a conductive pigment.

15. The element of claim 14 wherein the amount of conductive pigment is less than 20% by weight of the conductive barrier layer.

16. The element of claim 14 wherein the amount of conductive pigment is from 5 to 15% by weight of the conductive barrier layer.

17. The element of claim 14 wherein the conductive pigment is selected from the group consisting of photoconductive $TiO_2$, vanadium oxide, and $Sb_2O_3/SnO_2$ composite particles.

18. The element of claim 10 wherein the conductive additive is selected from the group consisting of conductive pigments, conductive polymers, doped conductive polymer compositions, and photoconductive organic molecules.

19. The element of claim 1 wherein the thickness of the electroconductive layer is in the range from 0.5 to 1.5 μm.

20. The element of claim 1 wherein the photoconductive layer is an inverted bilayer photoconductor.

* * * * *

UNITED STATES PATENT AND TRADEMARK OFFICE

CERTIFICATE OF CORRECTION

PATENT NO. : 5,756,246
APPLICATION NO. : 08/897024
DATED : May 26, 1998
INVENTOR(S) : Woo et al.

It is certified that error appears in the above-identified patent and that said Letters Patent is hereby corrected as shown below:

Title page, under "U.S. PATENT DOCUMENTS" please add:

--5,049,466 9/1991 Kyogoku et al.--

Title page, under "FOREIGN PATENT DOCUMENTS" please add:

--63036254 02/1988 Japan
63254463 10/1988 Japan--

Signed and Sealed this

Seventeenth Day of July, 2007

JON W. DUDAS
*Director of the United States Patent and Trademark Office*